US005568835A

United States Patent [19]

LaCount et al.

[11] Patent Number: 5,568,835

[45] Date of Patent: Oct. 29, 1996

[54] CONCENTRIC HEAT EXCHANGER HAVING HYDRAULICALLY EXPANDED FLOW CHANNELS

[75] Inventors: Dale F. LaCount; George B. Watson, both of Alliance, Ohio

[73] Assignee: The Babcock & Wilcox Company, New Orleans, La.

[21] Appl. No.: 506,672

[22] Filed: Jul. 25, 1995

[51] Int. Cl.[6] ..... F28D 7/10

[52] U.S. Cl. ..... 165/140; 165/141

[58] Field of Search ..... 165/140, 141, 165/154, 173

[56] References Cited

U.S. PATENT DOCUMENTS

| | | | |
|---|---|---|---|
| 2,160,898 | 6/1939 | Peff | 165/141 |
| 2,505,774 | 5/1950 | Holm et al. | 165/141 |
| 2,653,014 | 9/1953 | Sniader | 165/140 |
| 2,681,797 | 6/1954 | Van Vliet | 165/141 |
| 2,870,997 | 1/1959 | Söderstrom | 165/141 |
| 3,131,553 | 5/1964 | Ross | 165/140 |
| 3,788,281 | 1/1974 | Van Lookeren Campagne | 165/141 |
| 3,907,028 | 9/1975 | Lawson | 165/141 |
| 4,146,088 | 3/1979 | Pain | 165/141 |
| 4,215,743 | 8/1980 | Margittai | 165/141 |
| 4,295,255 | 10/1981 | Weber | 29/157.3 |
| 5,138,765 | 8/1992 | Watson et al. | 29/890.042 |
| 5,276,966 | 1/1994 | Grant et al. | 29/890.042 |

*Primary Examiner*—Edward K. Look
*Assistant Examiner*—Mark Sgantzos
*Attorney, Agent, or Firm*—Daniel S. Kalka; Robert J. Edwards

[57] ABSTRACT

A cylindrical heat exchanger assembly has a plurality of spaced cylindrical heat exchangers having bulge formed circumferential passageways spiraling along the cylindrical surface of each to form a passageway for heat transfer fluid flow therethrough and for allowing a second fluid to sealably flow in the spaces therebetween to establish heat transfer between the two fluids thereby.

9 Claims, 3 Drawing Sheets

CONCENTRIC HEAT EXCHANGER HAVING HYDRAULICALLY EXPANDED FLOW CHANNELS

BACKGROUND OF THE INVENTION

1. Field of the Invention

The present invention relates to heat exchangers generally and particularly to concentric heat exchanger having one media flowing internally within the heat exchanger and another heat transfer media flowing externally therethrough.

2. Description of the Related Art

There are a variety of heat exchangers using various designs of heat transfer surfaces. Air-cooled heat exchangers are known which consist of a bundle of smooth or finned tubes through which process fluid flows and is cooled by air blown over the tubes.

Shell-and-tube type heat exchangers are known which contain a number of tubes (smooth or finned) that are contained within a shell. Heat transfer tubes are placed between one fluid flowing inside the tubes with another fluid flowing outside the tubes and contained by the shell.

Plate heat exchangers consist of a series of parallel plates that are corrugated both to increase heat transfer and to give mechanical rigidity. They normally have flow paths in all four corners and are clamped together in a frame that has nozzles for line up with the plate ports. The nozzles are connected to external pipes that cover the two-fluid stream.

None of the above described heat exchangers have the strength and increased heat transfer characteristics of bulge formed heat exchanger surfaces.

The technique for forming such surfaces is known. One such hydraulic expansion technique is described in U.S. Pat. No. 4,295,255. Another method or technique is described in U.S. Pat. No. 5,138,765 as being used only on the internal surface of the flow channel. The specific application of the above hydraulic-expansion technique is applied to a stored chemical energy propulsion system. Therein the heat transfer effectiveness is improved both on the internal surface and is further enhanced by the flow channels. Strength is provided by a plate having the formed flow channels which are not bulge formed while the cover plate is bulge formed to provide added heat transfer surface and induce turbulent flow for increased heat transfer.

To date there are no known cylindrical heat exchangers that have hydraulically expanded or bulge formed flow channels on either one side or both sides of the heat transfer surfaces to provide strength and turbulent flow around these surfaces to increase heat transfer thereby. Clearly such designs are needed and would be beneficial to the art.

SUMMARY OF THE INVENTION

The present invention uses hydraulic expansion manufacturing technique to form cylindrical heat transfer surfaces. The flow channels within the surface are hydraulically expanded or bulge-formed on both sides as is described in U.S. Pat. No. 4,295,255 or are bulge formed on one side as described in U.S. Pat. No. 5,138,765. FIG. 1 shows an example of a cross section of such a hydraulically-expanded cylinder 10 having bulge-formed flow passage 18.

The cylindrical heat exchanger of the present invention has a series of concentric cylinders which are bulge-formed to provide an internal flow passage spiral formed around each of the series of cylinders. Flue gas is supplied at one end and exhausted out the other end of the cylindrical heat exchanger to cool the gas thereby.

An inlet header supplies each of the internal passages of the cylinders while an outlet header connects all the cylinder internal passage exhausts to thus have the bulge-formed flow passages of all the cylinders act as one fluid inlet and one fluid outlet connection. While the heat exchange fluid thus flows inside of the bulge-formed passages of the cylinders the flue gas flows outside the bulge-formed passages with turbulent flow around the bulge formed passages to provide an increased heat transfer rate between the flue gas and the heat exchange fluid flowing through the internal passages of the cylinders cooling the flue gas thereby.

In another embodiment, instead of the inlet and outlet headers connecting the bulge-formed passages of each cylinder, an interconnection between concentric cylinders is used with the fluid outlet of one concentric cylinder becoming the inlet to another concentric cylinder.

In yet another embodiment, different heat exchange fluids are passed through each cylinder of the plural cylinder bulge-formed heat exchanger while the annular spaces between the cylinders is sealably ducted to also have different fluids passed through each annulus which fluids are also different from the fluids passing through the bulge formed passages of each cylinder.

In view of the foregoing it will be seen that one aspect of the present invention is to provide a cylindrical heat exchanger having circumferentially formed spiral bulged passageway along a series of concentric cylinders of differing radius having a central axis.

Another aspect of the present invention is to provide a cylindrical heat exchanger having bulge formed heat transfer fluid passageways to induce turbulent fluid flow of the gas passing through the heat exchanger externally of the bulge formed passageways.

Yet another aspect of the present invention is to provide a cylindrical heat exchanger of plural cylinders having different heat exchange fluids flowing through each cylinder and the annular passageways formed between each cylinder.

These and other aspects of the present invention will be more fully understood after considering the following description of the preferred embodiment in conjunction with the accompanying drawings.

DESCRIPTION OF THE PREFERRED EMBODIMENT

Figure 1:
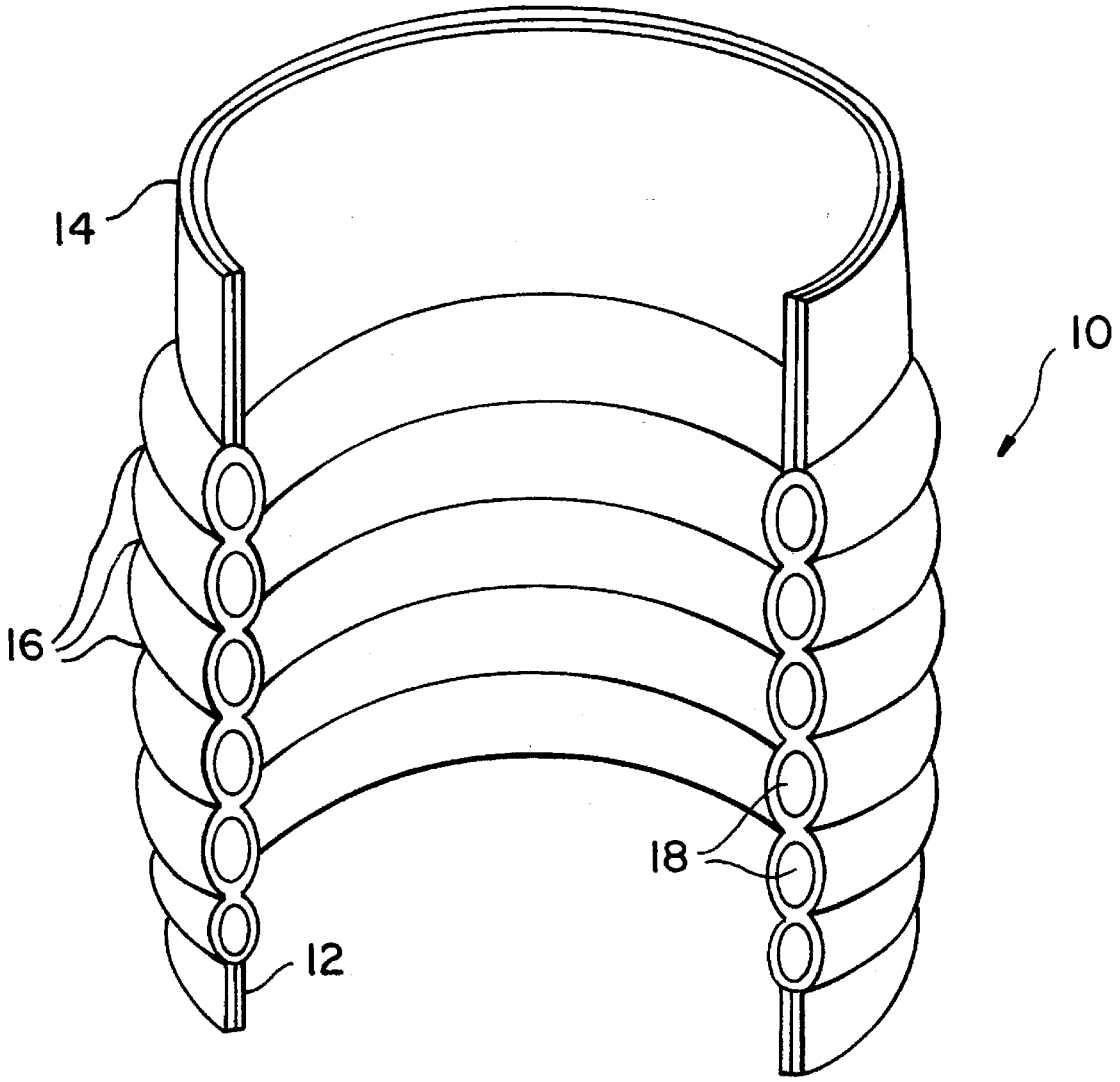
FIG.1 PRIOR ART
FIG. 1 is a cut away portion of a known prior art bulge formed cylindrical heat exchanger.

The present invention resides in a cylindrical heat exchanger fabricated with a hydraulic expansion manufacturing technique such as the coiled tube boiler (10) shown in FIG. 1. In fabricating the coiled tube boiler (10), one cylinder (12) is placed inside a second cylinder (14). It is seen that the two cylinders are of approximately the same diameter except for the inside cylinder (12) being than smaller outside cylinder (14). A high speed welding process, such as electron beam welding, welds in a spiral weld path (16) the two cylinders (12, 14) together. After welding, a pressure fitting (not shown) is attached and hydraulic pressure is applied between the welds (16) and the two cylinder sheets (12, 14). As the hydraulic pressure is slowly increased, the cylinders (12, 14) deform between the helical welds (16) to create a flow channel (18) therebetween. The manufacturing parameters are taught in U.S. Pat. No. 4,295,255 which is assigned to the present Assignee and is hereby incorporated by reference.

Further, the thickness of plate could be made significantly thicker and stronger to allow the bulge to form on only one side as is taught in U.S. Pat. No. 5,138,765.

Figure 2:
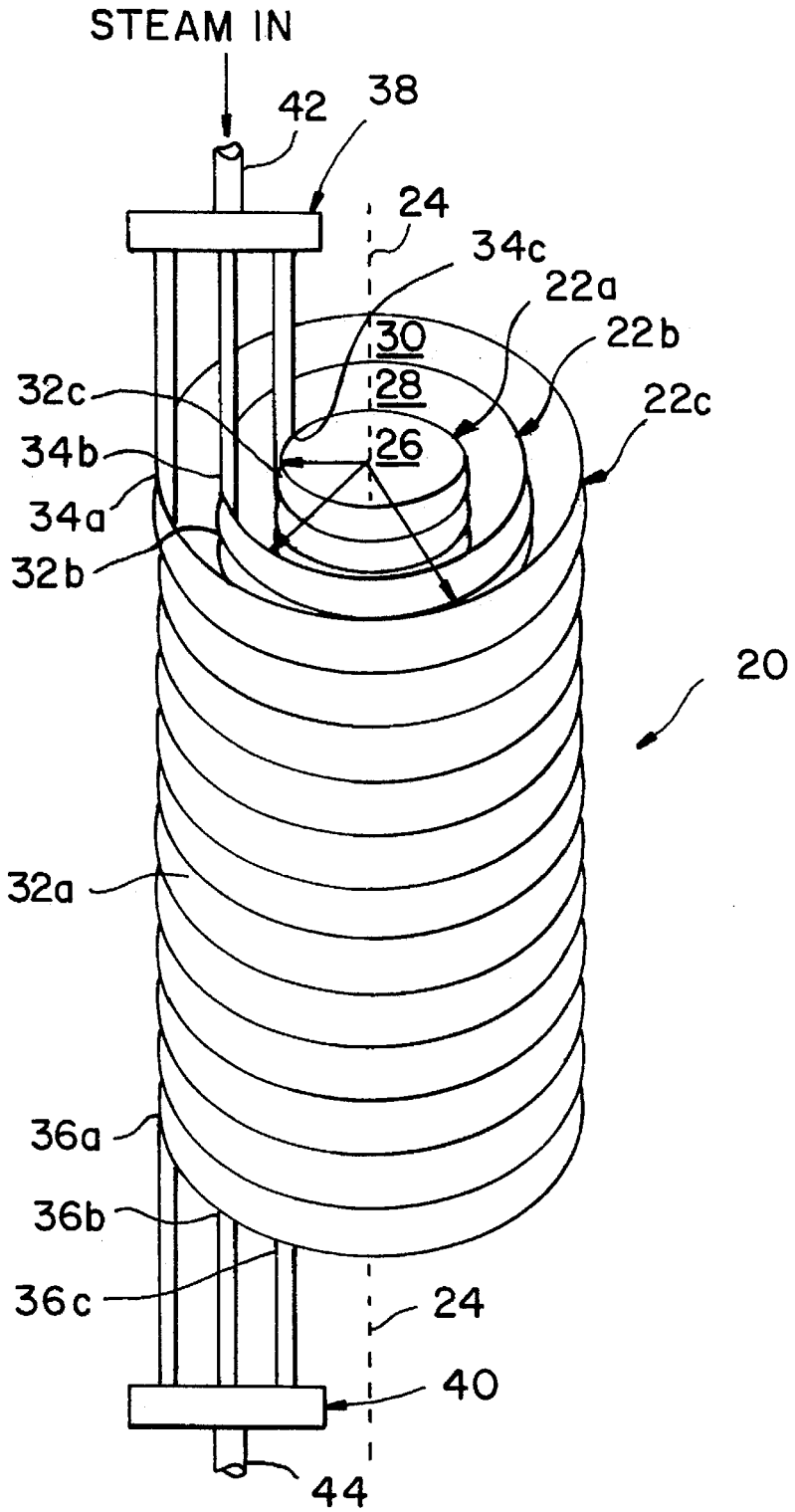
FIG. 2 is a schematic of the cylindrical heat exchanger of the present invention.

In the present invention, best seen with reference to FIG. 2, a cylindrical heat exchanger 20 is formed from a plurality of cylindrical heat exchangers 22(*a*); 22(*b*); 22(*c*) each having a significantly different radius $r^1$; $r^{11}$; $r^{111}$ but each being located concentrically within axis 24. This concentric relationship is maintained by any one of known structural supports such as radial struts (not shown).

The central cylindrical heat exchanger 22(*a*) has a tubular opening 26 for passing fluid therethrough while the adjoining heat exchangers 22(*b*) and 22(*c*) form annular openings 28, 30 for passing fluid therethrough.

It will be understood that each cylindrical heat exchanger 22(*a*); 22(*b*); 22(*c*); is formed according to the bulge forming process described with reference to FIG. 1 and has a circumferential spiral formed bulged fluid passageway 32(*a*); 32(*b*); 32(*c*) and a bottom fluid outlet 36(*a*); 36(*b*); 36(*c*). Although each cylindrical heat exchanger was shown as having both sides bulged, it will be understood that single side bulge could also be used when manufactured as per the teachings of U.S. Pat. No. 5,138,765. Also, while three concentric heat exchangers are shown, any number could be used as needed by the design parameters.

The heat exchanger 20 formed with the hydraulically-expanded flow channels can be used in industrial and utility boilers as the heat transfer surface for the superheat and reheat sections. Steam flow will then be in the inside of the bulge-formed flow channel 32(*a*); 32(*b*); 32(*c*) and flue gas flow will be in the central and annular flow passages 26; 28; 30. The steam is fed from a header 38 connected to the inlets 34 and is exhausted into a header 40 from outlets 36 to thus provide a single steam inlet 42 and outlet 44.

The construction of the present cylindrical heat exchanger provides certain advantages over prior art heat exchanger.

Flat plate may be used to make each cylinder. This allows the use of exotic and/or high-strength materials which are not available in tube form.

The size or compactness of the heat exchanger can be changed by varying the space between the concentric cylinders and the size of the bulge-formed flow channels.

The external surface of the bulge-formed flow passage is tube-like, which increases flow turbulence in the fluid flowing in crossflow between each concentric cylinder. The increase in flow turbulence increases the heat transfer effectiveness of the heat exchanger.

Figure 3:
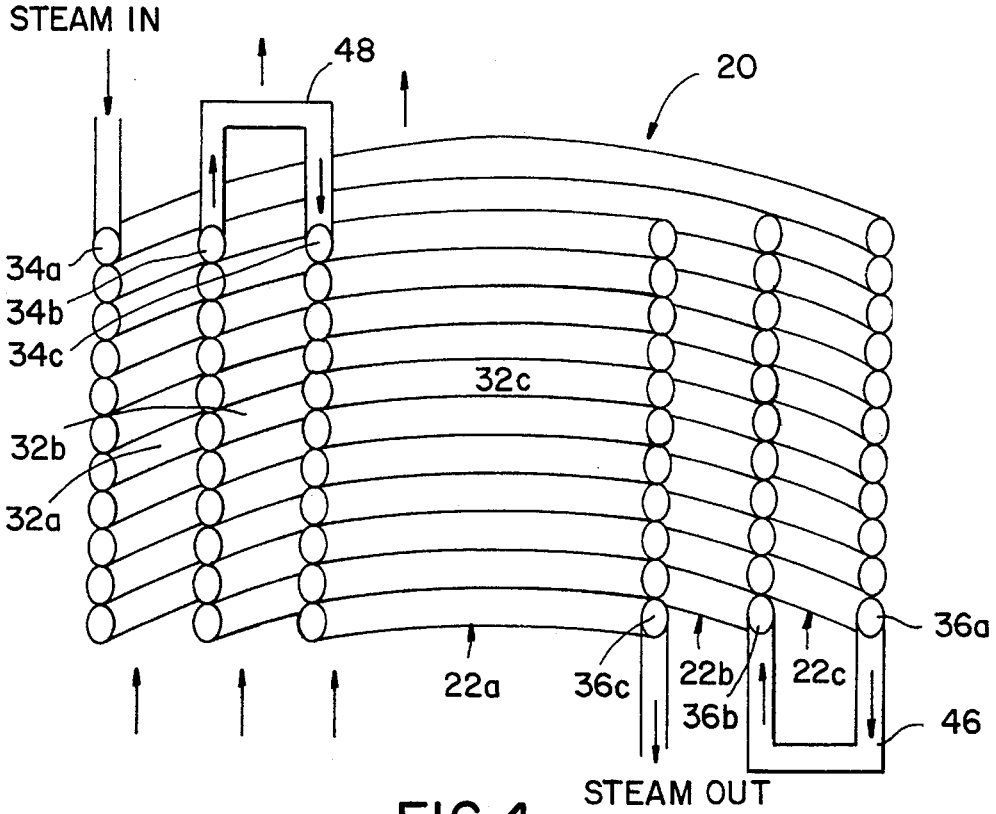
FIG. 3 is a schematic of the FIG. 2 cylindrical heat exchanger showing an alternate heat exchange fluid flow arrangement.

Turning now to FIG. 3, it will be seen that the headers 38 and 40 of FIG. 2 can be replaced with an interconnection between concentric cylinders 22 where the fluid outlet 36 of one cylinder 22 becomes the inlet of the adjoining cylinder 22 to allow cross current steam flow through cylinder 22(*b*).

Steam is passed to the inlet 34(*a*) of cylinder 22(*a*) and passes through the bulge formed passageway 32(*a*) to exit at outlet 36(*a*). A connection 46 then passes the steam to fluid outlet 36(*b*) of cylinder 22(*b*) where it flows counter current to cylinder 22(*a*) through passageways 32(*b*) to be exhausted at inlet 34(*b*). A second connection 48 then passes the steam to inlet 34(*c*) of cylinder 22(*c*) where it is passed through passageway 32(*c*) to exhaust 36(*c*).

Figure 4:
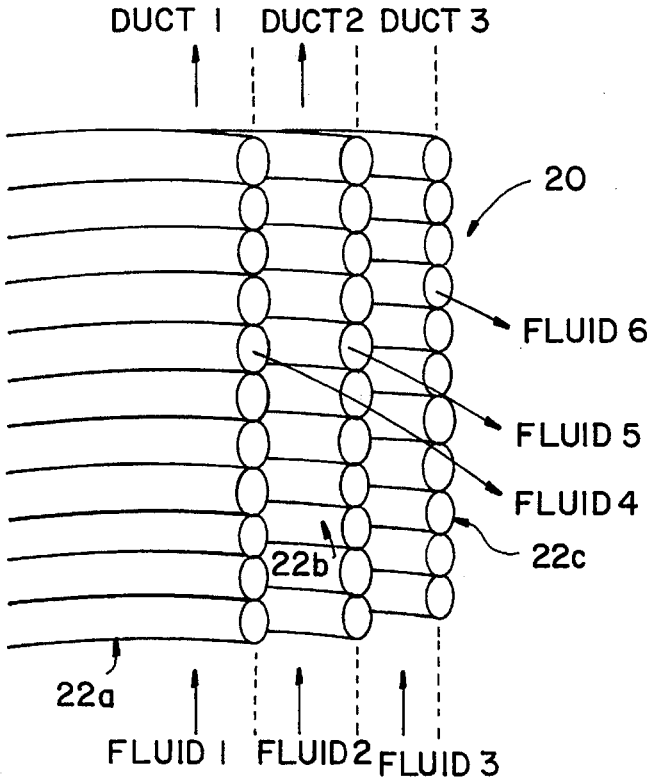
FIG. 4 is a schematic of the FIG. 2 cylindrical heat exchanger showing a plurality of different fluids flowing therethrough.

Turning next to FIG. 4, it will be seen that since each concentric cylinder 22 is a containment wall that can isolate the annular flow passages, different fluids can be used for each annular flow passage 26, 28, 30 with a different but common fluid on the inside of the bulge-formed passages.

Two other combinations can be provided by not using the inlet and outlet manifolds 38, 40 or headers to interconnect the bulge-formed flow passages 32. Separate tubes (not shown) on the inlets 34 and outlets 36 will allow use of different fluids on the inside of the bulge-formed flow passages 32 of each concentric cylinder 22 along with a common fluid in the annular flow passages 26, 28, 30 or different fluids in the annular flow passages 26, 28, 30.

While specific embodiments of the invention have been shown and described in detail to illustrate the application of the principles of the invention, it will be understood that certain modifications and additions would be obvious to those of ordinary skill in this art. Such modifications have been deleted herein for the sake of conciseness and readability but are intended to fall within the scope of the following claims.

What is claimed is:

1. A cylindrical hydraulically expanded heat exchanger assembly, comprising:

at least a pair of cylindrical heat exchangers, each having a bulge formed spiral passageway along the circumference thereof to allow a heat exchange fluid to pass therethrough, each of said cylindrical heat exchangers defining a containment wall for isolating a series of annular flow passages, said series of annular flow passages formed by the containment wall of each of said cylindrical heat exchangers being constructed to pass a fluid therethrough to establish heat transfer between the fluid passing through said series of flow passages and the heat exchange fluid in the bulge formed passageway of each cylindrical heat exchanger; and means for supplying the heat exchange fluid through each of said cylindrical heat exchangers.

2. A heat exchanger as set forth in claim 1 wherein said cylindrical heat exchangers are concentric and said series of flow passages includes a central tubular flow passage inside a centermost cylinder and an annular passageway between said centermost and an adjacent cylinder.

3. A heat exchanger as set forth in claim 2 wherein said bulge formed spiral passageways are formed to have bulges on both sides of the cylinder.

4. A heat exchanger as set forth in claim 2 further comprising a third cylindrical heat exchanger concentric with said pair of cylindrical heat exchangers, said third cylindrical heat exchanger having a bulge formed passageway therein for passing a heat exchange fluid therethrough, said third cylindrical heat exchanger being located outside said pair of cylindrical heat exchangers and defining another containment wall to form a second annular passageway between itself and the adjoining cylindrical heat exchanger.

5. A heat exchanger as set forth in claim 1 wherein said supplying means includes an inlet header for supplying a heat exchange fluid to each of said cylindrical heat exchangers and an outlet header for receiving the heat exchange fluid from each cylindrical heat exchanger.

6. A heat exchanger as set forth in claim 5 wherein said supplying means comprises:

an inlet to the passageway of each cylindrical heat exchanger;

an outlet from the passageway of each cylindrical heat exchanger;

heat exchanger fluid supply means to the inlet of said third cylindrical heat exchanger to allow the fluid to flow therethrough to the outlet thereof; and a connection between the outlet of said third heat exchanger and the outlet of the adjoining heat exchanger to allow the fluid to flow in the adjoining cylindrical heat exchanger in cross-current to the fluid flow in the third cylindrical heat exchanger.

7. A heat exchanger as set forth in claim 6 further comprising a second connection between the inlet of said adjoining cylindrical heat exchanger and the inlet of the centermost cylindrical heat exchanger to allow the fluid to flow to the outlet thereof parallel to the fluid flow in the third cylindrical heat exchanger.

8. A heat exchanger as set forth in claim 1 wherein said supplying means includes an individual inlet and outlet formed in each cylindrical heat exchanger with different heat exchange fluids being supplied to each heat exchanger.

9. A heat exchanger as set forth in claim 1 wherein different fluids are passed through each of the flow passages formed by said cylindrical heat exchangers.

* * * * *